US007993729B2

(12) United States Patent
Wise

(10) Patent No.: US 7,993,729 B2
(45) Date of Patent: Aug. 9, 2011

(54) SUBSTRATE FOR ARTIFICIAL TURF

(76) Inventor: Ronald Wise, Old Hickory, TN (US)

( * ) Notice: Subject to any disclaimer, the term of this patent is extended or adjusted under 35 U.S.C. 154(b) by 460 days.

(21) Appl. No.: 12/258,508

(22) Filed: Oct. 27, 2008

(65) Prior Publication Data

US 2010/0104778 A1 Apr. 29, 2010

(51) Int. Cl.
*B32B 3/20* (2006.01)
*B32B 3/30* (2006.01)
*E01C 13/08* (2006.01)

(52) U.S. Cl. ..... 428/188; 428/95; 428/17; 428/158; 428/167; 165/56; 165/53; 405/43

(58) Field of Classification Search ..... 428/17, 428/95, 156, 158, 160, 167, 172, 173, 188; 165/49, 53, 56; 219/213; 237/69; 405/43; 404/41, 35, 28, 29; 472/92
See application file for complete search history.

(56) References Cited

U.S. PATENT DOCUMENTS

| | | | | | |
|---|---|---|---|---|---|
| 2,721,731 | A | * | 10/1955 | Rapp | 165/56 |
| 3,246,689 | A | * | 4/1966 | Remde et al. | 165/53 |
| 3,771,787 | A | | 11/1973 | Wood, Jr. | |
| 4,489,115 | A | | 12/1984 | Layman et al. | |
| 4,508,162 | A | * | 4/1985 | Radtke | 165/56 |
| 4,535,021 | A | | 8/1985 | Friedrich | |
| H239 | H | * | 3/1987 | Franklin et al. | 165/47 |
| 4,646,814 | A | * | 3/1987 | Fennesz | 165/56 |
| 4,882,208 | A | | 11/1989 | Breitscheidel et al. | |
| 5,064,308 | A | * | 11/1991 | Almond et al. | 405/43 |
| 5,306,317 | A | * | 4/1994 | Yoshizaki | 47/1.01 R |
| 5,327,737 | A | * | 7/1994 | Eggemar | 62/66 |
| 5,368,092 | A | * | 11/1994 | Rearden et al. | 165/45 |
| 5,460,867 | A | * | 10/1995 | Magnuson et al. | 428/178 |
| 5,497,826 | A | * | 3/1996 | Ingram | 165/56 |
| 5,752,784 | A | * | 5/1998 | Motz et al. | 405/37 |
| 5,976,645 | A | * | 11/1999 | Daluise et al. | 428/17 |
| 6,092,587 | A | * | 7/2000 | Ingram | 165/56 |
| 6,156,396 | A | | 12/2000 | Florian | |
| 6,221,445 | B1 | | 4/2001 | Jones | |
| 6,299,959 | B1 | | 10/2001 | Squires et al. | |
| 6,338,885 | B1 | | 1/2002 | Prevost | |
| 6,602,113 | B2 | | 8/2003 | Lemieux | |

(Continued)

FOREIGN PATENT DOCUMENTS

DE 20302982 U1 * 2/2004

(Continued)

*Primary Examiner* — Cheryl Juska
(74) *Attorney, Agent, or Firm* — Gifford, Krass, Sprinkle, Anderson & Citkowski, P.C.

(57) ABSTRACT

Disclosed is a substrate for artificial turf that includes a base pad with a channel that extends across an upper surface of the pad and a tube that lies within the channel. The base pad has a generally flat lower surface and a generally flat upper surface that is spaced apart and oppositely disposed from the lower surface. The channel has a sidewall and a bottom surface, the sidewall extending from the upper surface of the base pad to the bottom surface of the channel and the bottom surface being spaced apart from the lower surface of the base pad. The tube has a sidewall defining an inner diameter surface and an outer diameter surface, with at least one aperture through the sidewall adjoining the inner diameter surface and the outer diameter surface. The channel and the tube are operable for liquid to flow through. In some instances, a radiant heating wire can extend across the upper surface of the base pad.

20 Claims, 3 Drawing Sheets

U.S. PATENT DOCUMENTS

| | | | | |
|---|---|---|---|---|
| 6,689,447 | B2 | 2/2004 | Prevost | |
| 6,740,387 | B1 | 5/2004 | Lemieux | |
| 6,858,272 | B2 | 2/2005 | Squires | |
| 6,877,932 | B2 | 4/2005 | Prevost | |
| 6,955,841 | B2 | 10/2005 | Weghuis et al. | |
| 6,989,179 | B2 | 1/2006 | Prevost et al. | |
| 7,014,390 | B1 * | 3/2006 | Morris | 405/50 |
| 7,128,497 | B2 * | 10/2006 | Daluise | 405/43 |
| 7,140,426 | B2 * | 11/2006 | Huebner et al. | 165/170 |
| 7,147,401 | B2 * | 12/2006 | Wickens | 405/45 |
| 7,153,553 | B2 * | 12/2006 | Tetrault | 428/17 |
| 7,244,477 | B2 * | 7/2007 | Sawyer et al. | 428/17 |
| 7,387,823 | B2 * | 6/2008 | Waterford | 428/17 |
| 7,578,635 | B2 * | 8/2009 | Blackwood | 405/50 |
| 7,645,501 | B2 * | 1/2010 | Sawyer et al. | 428/95 |
| 7,758,281 | B2 * | 7/2010 | Knox | 405/43 |
| 7,758,759 | B2 * | 7/2010 | James et al. | 216/42 |
| 7,815,395 | B1 * | 10/2010 | Blackwood | 405/50 |
| 2002/0029515 | A1 | 3/2002 | Prevost | |
| 2003/0056432 | A1 * | 3/2003 | Prevost | 47/1.01 F |
| 2004/0081771 | A1 * | 4/2004 | Waterford | 428/17 |
| 2005/0042032 | A1 * | 2/2005 | Motz et al. | 405/43 |
| 2006/0078386 | A1 * | 4/2006 | Blackwood | 405/43 |
| 2006/0115328 | A1 * | 6/2006 | Smyers | 405/50 |
| 2006/0172092 | A1 * | 8/2006 | Tetrault | 428/17 |
| 2007/0116521 | A1 * | 5/2007 | Kim | 405/43 |
| 2008/0075896 | A1 * | 3/2008 | Sawyer et al. | 428/17 |
| 2008/0176010 | A1 | 7/2008 | Sawyer et al. | |
| 2009/0246418 | A1 | 10/2009 | Wise | |
| 2010/0198414 | A1 * | 8/2010 | Kroll et al. | 700/278 |
| 2010/0203265 | A1 * | 8/2010 | Tetrault et al. | 428/17 |

FOREIGN PATENT DOCUMENTS

| | | | | |
|---|---|---|---|---|
| FR | 2757346 | A1 | * | 6/1998 |
| JP | 01199520 | A | * | 8/1989 |
| JP | 04073304 | A | * | 3/1992 |
| JP | 04080407 | A | * | 3/1992 |
| JP | 05132909 | A | * | 5/1993 |
| JP | 06292751 | A | * | 10/1994 |
| JP | 07317010 | A | * | 12/1995 |
| JP | 07317011 | A | * | 12/1995 |
| JP | 2000032841 | A | * | 2/2000 |
| WO | WO-03025288 | A1 | | 3/2003 |

* cited by examiner

SUBSTRATE FOR ARTIFICIAL TURF

FIELD OF THE INVENTION

This invention relates generally to artificial turf. More specifically, the invention relates to a substrate for artificial turf.

BACKGROUND OF THE INVENTION

Synthetic turf, also known as artificial turf, is a grass-like surface manufactured from synthetic materials. Although items such as floor mats, rugs and the like can be produced from artificial turf, it is most often used in stadiums and fields where sports are played upon. Some of the advantages of using artificial turf are its extended lifetime compared to natural turf and its ability to provide a suitable playing surface in environments that are unsuitable for natural grass. One of the disadvantages of artificial turf is the tendency for the artificial surface to be much hotter than natural grass when exposed to direct sunlight and to appear harder than natural surfaces in extreme cold. Therefore, an artificial turf substrate that would provide cooling for the artificial surface when exposed to hot environments and heating when exposed to cold environments would be desirable. In addition, a substrate that provides for improved water management for artificial turf would also be desirable.

SUMMARY OF THE INVENTION

Disclosed is a substrate for artificial turf that includes a base pad with a channel that extends across an upper surface of the base pad and a tube that lies within the channel. The base pad has a generally flat lower surface and a generally flat upper surface that is spaced apart and oppositely disposed from the lower surface. The channel has a sidewall and a bottom surface, the sidewall extending from the upper surface of the base pad to the bottom surface of the channel. The bottom surface is spaced apart from the lower surface of the base pad. The tube has a sidewall defining an inner diameter surface and an outer diameter surface, with at least one aperture through the sidewall adjoining the inner diameter surface and the outer diameter surface. The channel and the tube are operable for liquid to flow through.

The base pad is made from an elastomeric foam material and the channel can be generally U-shaped. Optional features that can be part of the present invention include drain holes that extend from the bottom surface of the channel to the lower surface of the base pad, a radiant heating wire embedded within the base pad proximate the upper surface and a layer of nonwoven carpet extending across the upper surface of the base pad. The nonwoven carpet has a bottom surface that can be fixedly attached to the upper surface of the base pad and an opening that is in alignment with the channel extending across the upper surface.

DETAILED DESCRIPTION OF THE PREFERRED EMBODIMENTS

The present invention includes a substrate for artificial turf that affords for the cooling, heating and/or water management of artificial grass that is present on the substrate. As such, the present invention has utility as a base material for artificial turf. In addition, the present invention has utility for improving the playing conditions for players, athletes and the like which play, compete, etc. on artificial turf.

The substrate of the present invention is made from an elastomeric foam material and has channels running across an upper surface of the substrate, the channels providing an avenue for water drainage and/or water supply to artificial grass present on the substrate. In this manner, the artificial grass can be cooled by water passing through the substrate. In addition, water that has accumulated on the artificial surface can be drained away. In some instances a radiant heating wire can be included proximate the upper surface of the substrate, the wire affording for heating of the substrate and artificial grass on top thereof.

Figure 1:
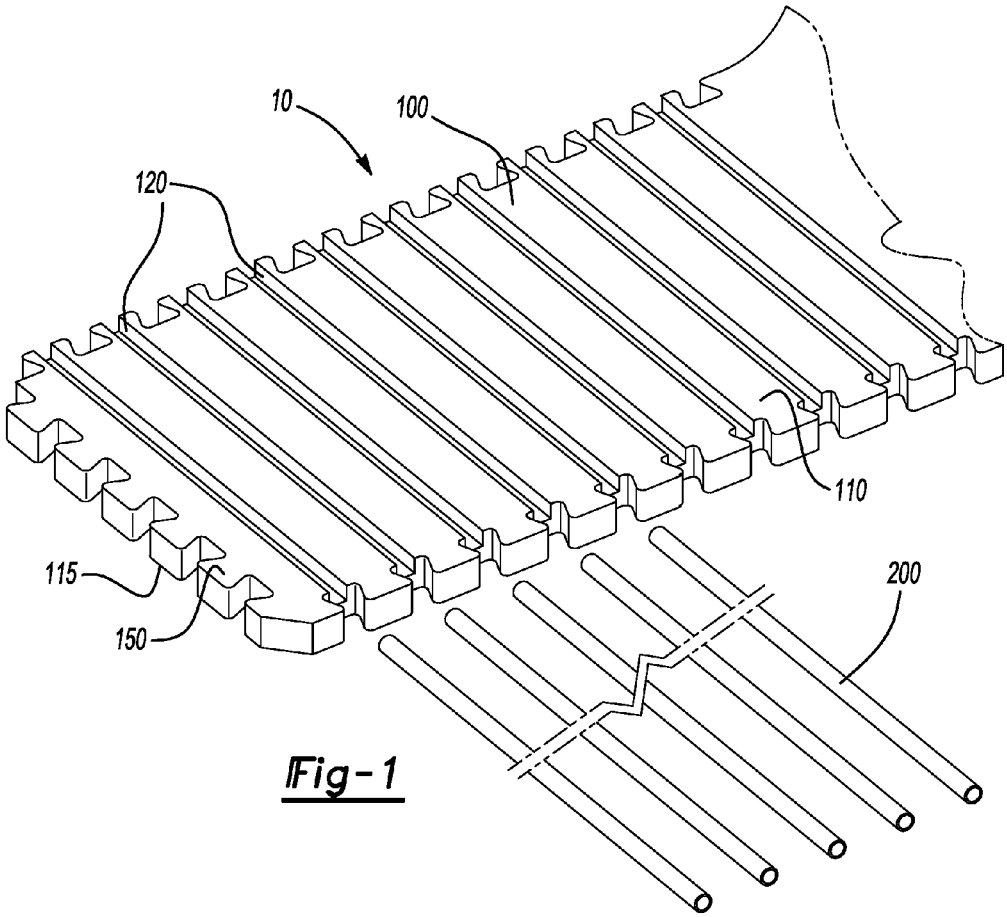
FIG. 1 is a perspective view of an embodiment of the present invention.

Referring now to FIG. 1, an embodiment of the present invention is illustrated generally at reference numeral 10. The substrate 10 includes a base pad 100, the base pad 100 having an upper surface 110 and a lower surface 115. Extending from the top surface 110 in a direction towards the bottom surface 115 is a channel 120. The base pad 100 can also include interlocking tabs 150 which afford for the attachment of adjacent base pads 100 to each other. In some instances, tubing 200 can be inserted at least partially within the channel 120.

Figure 2:
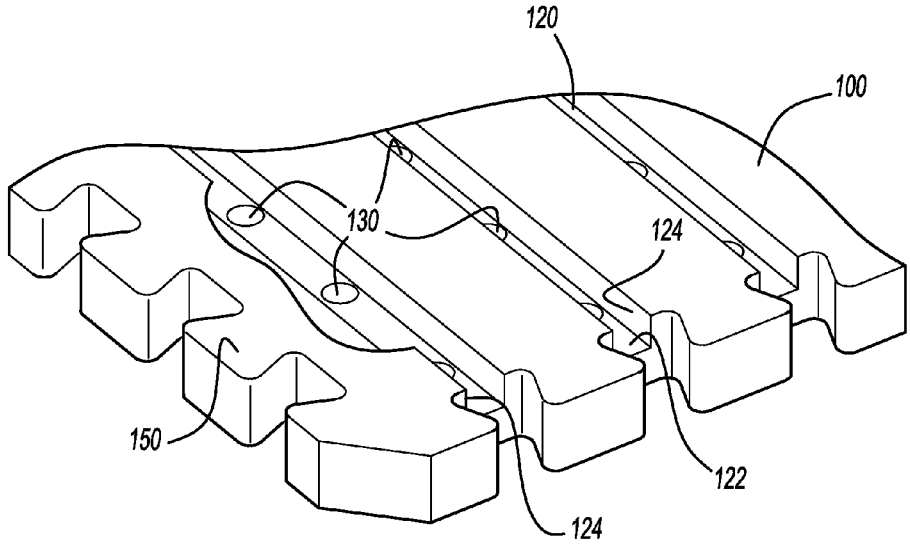
FIG. 2 is a perspective view of an embodiment of the present invention wherein optional drain holes are illustrated.

In another embodiment of the present invention, the base pad 100 can include drain holes 130 as illustrated in FIG. 2. The drain holes 130 extend from a bottom surface 122 of the channel 120 to the lower surface 115 of the base pad 100. In this manner, the drain holes 130 afford for the passage of liquid, for example water, from the channel 120 to the lower surface 115 and thus away from the artificial grass that would be present on the upper surface 110 of the base pad 100. The channel 120 includes a sidewall 124 that extends in a direction from the upper surface 110 towards the lower surface 115. The sidewall 124 extends to the bottom surface 122 of the channel 120, the bottom surface 122 being spaced apart from the lower surface 115 of the base pad 100.

Figure 3:
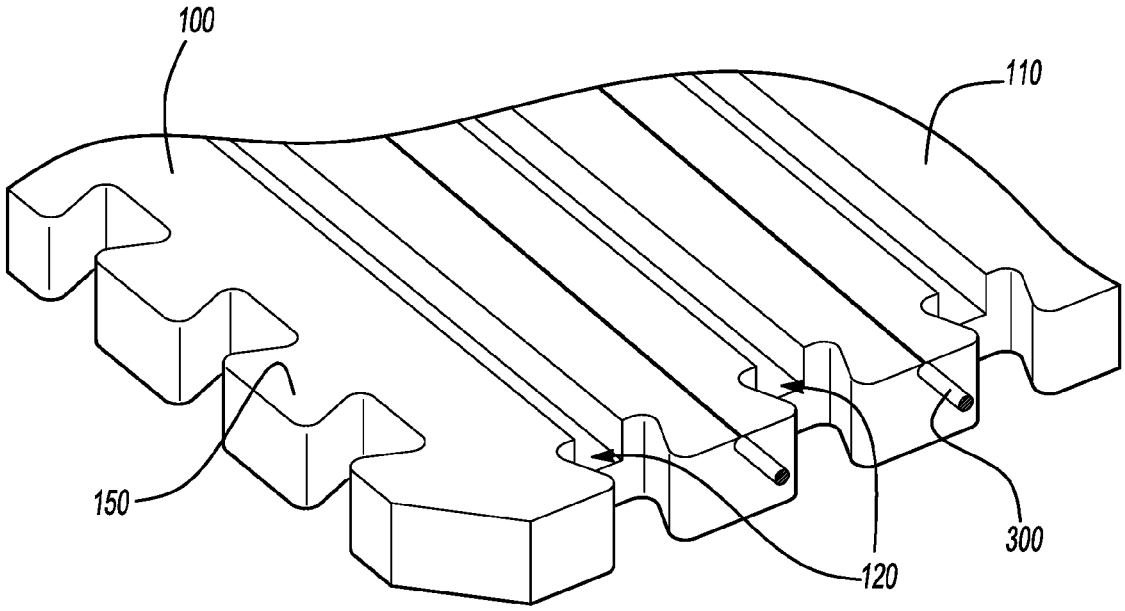
FIG. 3 is a perspective view of an embodiment of the present invention wherein an optional radiant heating wire is illustrated.

Turning now to FIG. 3, another embodiment of the present invention can include a radiant heating wire 300 that extends across the upper surface 110. In some instances the radiant heating wire 300 is embedded within the base pad 100 proximate the upper surface 110. The radiant heating wire 300 can afford for heating of artificial grass that is present on top of the base pad 100. As illustrated in FIG. 3, the radiant heating wire 300 can extend across the upper surface 110 between two parallel channels 120.

Figure 4:
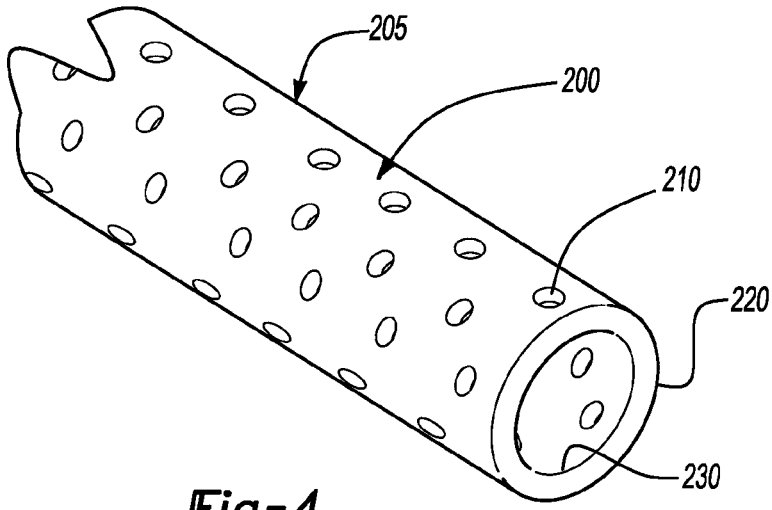
FIG. 4 is a perspective view illustrating a tube that can be used in the present invention.

Looking particularly at FIG. 4, the tubing 200 has a sidewall 205 that defines an outer diameter surface 220 and an inner diameter surface 230. In an embodiment of the present invention, apertures 210 can be included within the tubing 200, the apertures 210 extending from the outer diameter surface 220 to the inner diameter surface 230, and thus through the sidewall 205. The tubing 200 with the apertures 210 afford for water to be brought into contact with the base pad 100 and artificial grass that is present thereon. The tubing 200 with apertures 210 can also afford for water passing through the artificial grass to be drained away therefrom. In some instances, water that flows through the tube 200 is used to cool the artificial turf. In another embodiment, the tubing 200 does not have apertures 210 and can be used as a cooling tube and/or heating tube with a liquid and/or gas running therethrough.

Figure 5:
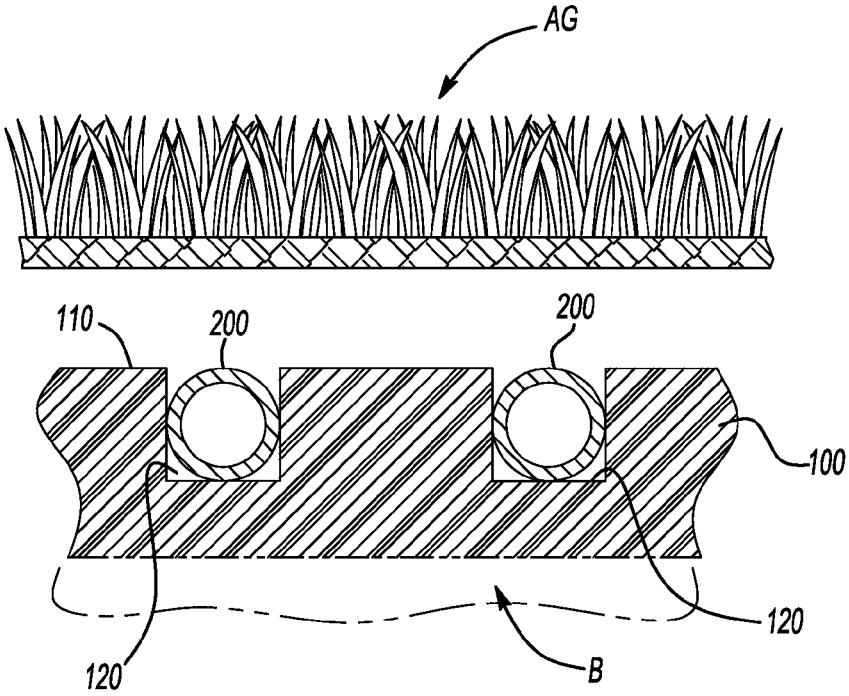
FIG. 5 is a side cross-sectional view of an embodiment of the present invention.
Figure 6:
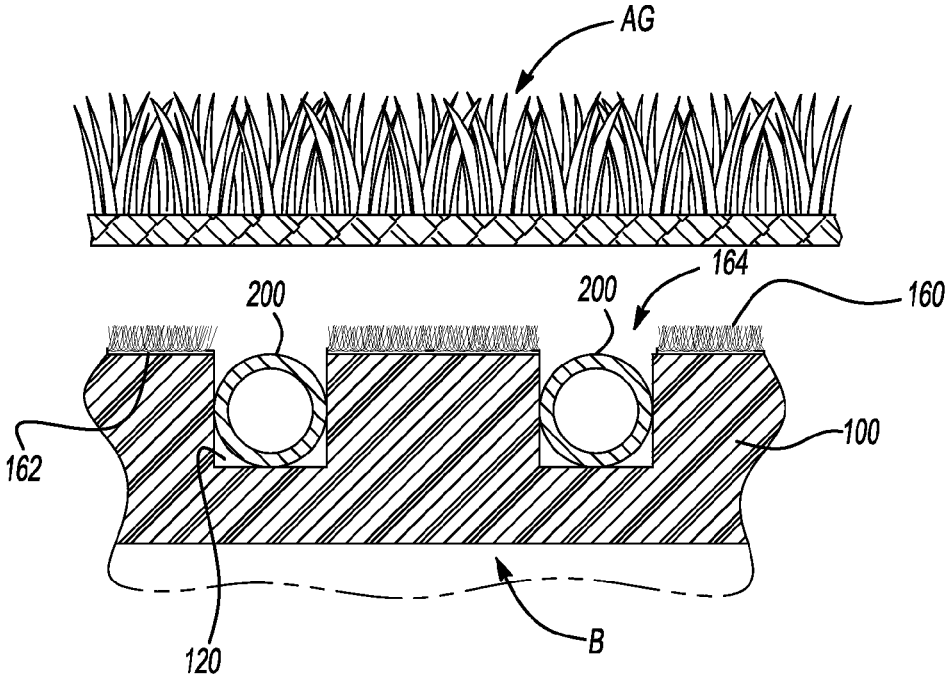
FIG. 6 is a side cross-sectional view of an embodiment of the present invention.

Turning now to FIGS. 5 and 6, a cross-sectional side view of two embodiments of the present invention are shown. In FIG. 5, the base pad 100 with channels 120 has tubing 200 inserted therein. On top of the base pad 100 and extending across the upper surface 110, artificial grass AG is present and can be placed thereon. Underneath the base pad 100 is bedding B, the bedding typically including soil, sand, gravel, concrete asphalt and/or combinations thereof. In FIG. 6, the base pad 100 includes a nonwoven carpet 160 extending across the upper surface 110. In some instances, the nonwoven carpet 160 has a bottom surface 162 that is fixedly attached to the upper surface 110 of the base pad 100. The nonwoven carpet 160 can include an opening 164 that is in alignment with the channel 120 of the base pad 100. In the alternative, the nonwoven carpet 160 does not have the opening 162 and is continuous across the upper surface 110 and channels 120. Although not shown in the figures, other layers of material can be located between the base pad 100 and the artificial grass AG. For example, a fiberglass scrim can be placed between base pad 100 and the artificial grass AG or between the nonwoven carpet 160 that extends across the upper surface 110 and the artificial grass AG.

In this manner, a substrate that affords for cooling, heating and/or water management of artificial turf is provided. In addition, the foregoing drawings, discussion and description are illustrative of specific embodiments of the present invention, but they are not meant to be limitations upon the practice thereof. Numerous modifications and variations of the invention will be readily apparent to those of skill in the art in view of the teaching presented herein. It is the following claims, including all equivalents, which define the scope of the invention.

I claim:

1. A substrate for artificial turf, said substrate comprising:
a base pad having a generally flat lower surface and a generally flat upper surface spaced apart and oppositely disposed from said lower surface;
a channel extending across said upper surface, said channel having a sidewall extending from said upper surface of said base pad in a direction towards said lower surface to a bottom surface of said channel, said bottom surface spaced apart from said lower surface of said base pad; and
a tube dimensioned to lay at least partially within said channel and not extending above said upper surface of said base pad, said tube having a sidewall defining an inner diameter surface and an outer diameter surface, and an aperture through said sidewall adjoining said inner diameter surface and said outer diameter surface, said tube operable for liquid to flow through.

2. The substrate of claim 1, wherein said base pad is made from elastomeric foam material.

3. The substrate of claim 1, wherein said channel is a generally U-shaped channel.

4. The substrate of claim 1, wherein said base pad has drain holes extending from said bottom surface of said channel to said lower surface of said base pad.

5. The substrate of claim 1, further comprising a radiant heating wire within said base pad.

6. The substrate of claim 5, wherein said radiant heating wire is embedded within said base pad proximate said upper surface.

7. The substrate of claim 1, further comprising:
a layer of nonwoven carpet extending across said upper surface of said base pad.

8. The substrate of claim 7, wherein said layer of nonwoven carpet has a bottom surface that is fixedly attached to said upper surface of said base pad.

9. The substrate of claim 8, wherein said layer of nonwoven carpet has an opening in alignment with said channel extending across said upper surface of said base pad.

10. A substrate for artificial turf, said substrate comprising:
a base pad having a generally flat lower surface and a generally flat upper surface spaced apart and oppositely disposed from said lower surface;
a channel extending across said upper surface, said channel having a sidewall extending from said upper surface of said base pad in a direction towards said lower surface to a bottom surface of said channel, said bottom surface spaced apart from said lower surface of said base pad;
a tube dimensioned to lay at least partially within said channel and not extending above said upper surface of said base pad, said tube having a sidewall defining an inner diameter surface and an outer diameter surface, and an aperture through said sidewall adjoining said inner diameter surface and said outer diameter surface, said tube operable for liquid to flow through; and
a layer of nonwoven carpet extending across said upper surface of said base pad.

11. The substrate of claim 10, wherein said base pad is made from elastomeric foam material.

12. The substrate of claim 10, wherein said channel is a generally U-shaped channel.

13. The substrate of claim 10, wherein said base pad has drain holes extending from said bottom surface of said channel to said lower surface of said base pad.

14. The substrate of claim 10, further comprising a radiant heating wire within said base pad.

15. The substrate of claim 14, wherein said radiant heating wire is embedded within said base pad proximate said upper surface.

16. The substrate of claim 10, wherein said layer of nonwoven carpet has a bottom surface that is fixedly attached to said upper surface of said base pad.

17. The substrate of claim 16, wherein said layer of nonwoven carpet has an opening in alignment with said channel extending across said upper surface of said base pad.

18. A substrate for artificial turf, said substrate comprising:
a base pad having a generally flat lower surface and a generally flat upper surface spaced apart and oppositely disposed from said lower surface;
a generally U-shaped channel extending across said upper surface, said channel having a sidewall extending from said upper surface of said base pad in a direction towards said lower surface to a bottom surface of said channel, said bottom surface spaced apart from said lower surface of said base pad;
a tube dimensioned to lay at least partially within said channel and not extending above said upper surface of said base pad, said tube having a sidewall defining an inner diameter surface and an outer diameter surface, and an aperture through said sidewall adjoining said inner diameter surface and said outer diameter surface, said tube operable for liquid to flow through; and a layer of nonwoven carpet extending across said upper surface of said base pad, said layer of nonwoven carpet having a bottom surface fixedly attached to said upper surface of said base pad.

19. The substrate of claim 18, further comprising a radiant heating wire embedded within said base pad proximate said upper surface.

20. The substrate of claim 18, wherein said layer of nonwoven carpet has an opening in alignment with said generally U-shaped channel extending across said upper surface of said base pad.

* * * * *